US005897179A

United States Patent [19]

Wade

[11] Patent Number: 5,897,179

[45] Date of Patent: Apr. 27, 1999

[54] APPARATUS FOR MOUNTING COMPUTER EQUIPMENT

[75] Inventor: Chris G. Wade, Gladstone, Mo.

[73] Assignee: Western Auto Supply Company, Kansas City, Mo.

[21] Appl. No.: 08/940,452

[22] Filed: Sep. 30, 1997

[51] Int. Cl.[6] ..... A47B 97/00

[52] U.S. Cl. ..... 312/223.6; 312/140.4; 108/50.02

[58] Field of Search ..... 312/223.3, 223.4, 312/223.5, 223.6, 140.4, 140.3, 140.1, 196, 213, 245; 108/25, 50.01, 50.02

[56] References Cited

U.S. PATENT DOCUMENTS

| | | | |
|---|---|---|---|
| 2,688,525 | 9/1954 | Lindstrom | 312/140.1 |
| 2,729,529 | 1/1956 | Hoven et al. | 312/245 X |
| 3,202,468 | 8/1965 | Kegel | 312/223.6 X |
| 3,373,703 | 3/1968 | Barecki | 108/50.01 |
| 3,829,187 | 8/1974 | Stewart | 312/140.1 |
| 4,535,703 | 8/1985 | Henriott et al. | 312/223.6 X |
| 5,568,773 | 10/1996 | Hung | 108/50.02 |

*Primary Examiner*—Peter M. Cuomo
*Assistant Examiner*—Janet M. Wilkens
*Attorney, Agent, or Firm*—Shook, Hardy & Bacon L.L.P.

[57] ABSTRACT

A fixture for mounting point of sale equipment on a counter includes a shelf supported beneath the counter and cable guides that extend over the top of the counter and around an edge thereof. The shelf includes a bottom wall and a plurality of upstanding side walls secured between the bottom wall and the counter. A generally horizontal cable guide includes a top wall and a plurality of depending side walls, and the side walls are slotted for receipt of the equipment cables so that the cables on the counter are concealed within the cable guide. A generally vertical cable guide is connected between the shelf and the horizontal cable guide, and includes a front wall and a pair of laterally spaced front side walls secured to the front wall and adapted to extend between the front wall and the edge of the counter so that the equipment cables passing around the edge of the counter are concealed within the vertical cable guide.

14 Claims, 2 Drawing Sheets

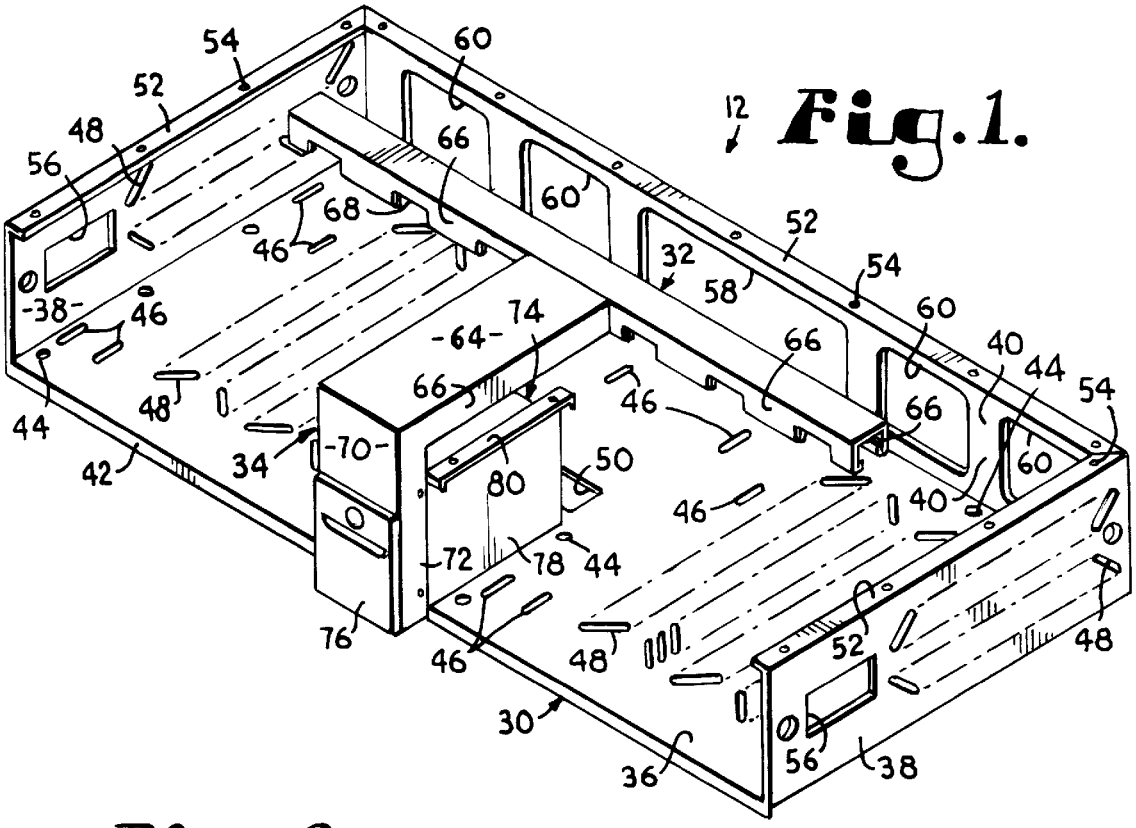
Fig. 1.
Fig. 2.
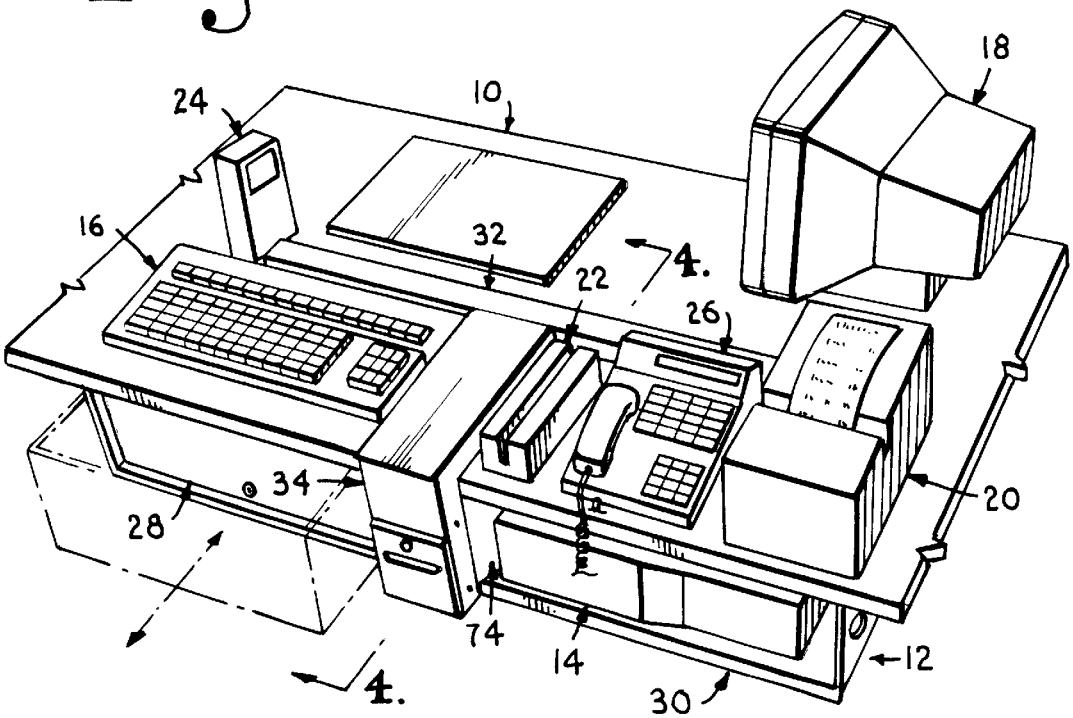

APPARATUS FOR MOUNTING COMPUTER EQUIPMENT

CROSS-REFERENCE TO RELATED APPLICATIONS

"Not Applicable"

STATEMENT REGARDING FEDERALLY SPONSORED RESEARCH OR DEVELOPMENT

"Not Applicable"

BACKGROUND OF THE INVENTION

The present invention relates generally to equipment support fixtures, and more particularly to a fixture for mounting point of sale equipment on a counter and for managing the cables that interconnect the equipment.

Point of sales equipment has evolved dramatically over the years since the days of the cash register, and is now typically computerized, including in many instances a central processing unit, an input keyboard, a monitor, a printer, a credit card reader, a product code scanner, a telephone, and other now conventional input and output devices. This radical increase in the amount of equipment required to manage retail sales and inventory has created many problems for those designing point of sale fixtures, including how to make the most efficient use of the space allotted to point of sale activities, and how to manage the many cables that extend between and interconnect the equipment without creating an unsightly tangle that interferes with normal sales efforts.

It is conventional in many retail environments to construct a point of sale counter with an underlying shelf on which some of the equipment such as the central processing unit and the cash drawer are mounted. With such an arrangement, the remaining equipment is positioned on the counter top and cables connecting the counter top equipment to the central processing unit are either trained over the front edge of the counter or threaded through access holes drilled through the counter. An unsightly tangle of cables typically results from attempts to bundle the cables and pass them over the edge of the counter. In addition, it is difficult to clean in and around such bundles and they frequently collect dust and debris, giving an unkept appearance.

By providing access holes in the counter, these unattractive cable bundles are hidden from view, and it is much easier to manage and clean the point of sales area. However, access holes represent a permanent alteration to the counter that are not easily covered, and it is troublesome to move the point of sale along the counter without substantially reconstructing the original location on the counter.

BRIEF SUMMARY OF THE INVENTION

It is an object of the present invention to provide an apparatus for mounting equipment on a counter in such a way that the equipment is easily accessible to the sales clerk, all cables interconnecting the equipment are substantially hidden from view, and access holes need not be drilled through the counter.

In accordance with these and other objects evident from the following description of a preferred embodiment of the invention, an apparatus is provided for mounting equipment on a counter, wherein some of the equipment is to be supported on the counter and other of the equipment is to be supported beneath the counter. The apparatus includes a shelf supported beneath the counter for mounting some of the equipment, and a pair of cable guides for managing any cables that extend between the equipment on and beneath the counter.

The shelf of the apparatus is comprised of a bottom wall and a plurality of upstanding lower side walls that are secured between the bottom wall and a lower surface of the counter. One of the cable guides is a generally horizontal guide, and includes a top wall and a plurality of depending upper side walls secured to the top wall and adapted to extend between the top wall and the upper surface of the counter. The upper side walls present a plurality of slots sized for receipt of the equipment cables so that the cables on the counter are concealed within the horizontal cable guide and guided to the front edge of the counter.

The other cable guide is vertically oriented, connecting the horizontal guide with the shelf and including a front wall and a pair of laterally spaced front side walls. The vertical guide encloses the cables passing around the edge of the counter so that they are concealed as they are directed toward the equipment on the shelf.

By providing a mounting apparatus in accordance with the present invention, numerous advantages are realized. For example, by providing a unitary shelf and cable guide, a construction results which is easy to install and manages the cables extending between the equipment on and beneath the counter. In addition, the construction obviates the need for separate shelving or for access holes through the counter, permitting the fixture to be used on any conventional counter and moved without great expense or hardship.

BRIEF DESCRIPTION OF THE SEVERAL VIEWS OF THE DRAWING

The preferred embodiment of the present invention is described in detail below with reference to the attached drawing, wherein:

FIG. 1 is a perspective view of a mounting apparatus constructed in accordance with the preferred embodiment;

FIG. 2 is a perspective view of a point of sale counter and computer equipment, illustrating an environment of use of the mounting apparatus;

DETAILED DESCRIPTION OF THE INVENTION

Figure 3:
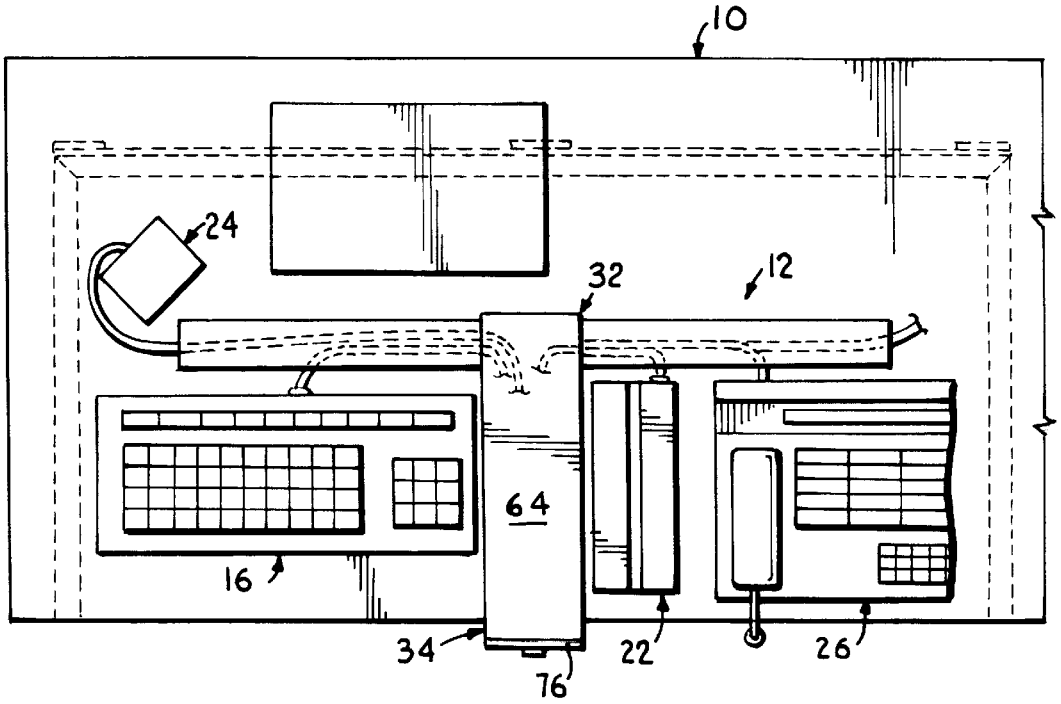
FIG. 3 is a fragmentary top plan view of the point of sale counter, illustrating a cable guiding function performed by the mounting apparatus.

A point of sale station employing a mounting apparatus constructed in accordance with the preferred embodiment of the invention is shown in FIG. 2. The station is positioned along a conventional counter 10, and includes the mounting apparatus 12 and all necessary point of sale equipment such as a central processing unit 14, a keyboard 16, a monitor 18, a printer 20, a card reader 22, a product code scanner 24, a telephone 26 and a cash drawer 28.

The mounting apparatus 12 is preferably constructed of sheet metal, and is designed to support the central processing unit 14 and cash drawer 28 beneath the counter, and to manage the various cables that extend between the central processing unit and the other equipment on the counter. The apparatus is shown in FIG. 1, and broadly includes a shelf 30 that extends beneath the counter, a horizontal cable guide 32 that extends above the counter, and a vertical cable guide 34 that connects the shelf and horizontal guide together so that the shelf and guides present a unitary assembly.

The shelf 30 includes a horizontal bottom wall 36, a pair of laterally spaced upstanding lower side walls 38, and an upstanding lower rear wall 40. The side and rear walls 38, 40 are secured to the bottom wall and extend between the bottom wall and the lower surface of the counter to close off the sides and rear of the shelf, leaving the front side of the shelf open for receipt of the central processing unit and the cash drawer. Preferably, the front edge 42 of the bottom wall is rolled downward and inward to strengthen the edge and provide added support for the equipment on the shelf.

The bottom wall 36 is constructed to facilitate securement of the apparatus on the counter, and to permit proper mounting and operation of the equipment. A number of access holes 44 are formed around the side and rear edges of the bottom wall in alignment with corresponding smaller holes formed in the side and rear walls 38, 40. These access holes 44 provide access to the smaller upper holes through the bottom wall so that the apparatus can be secured to the counter.

A plurality of slots 46 are formed in the bottom wall at spaced locations corresponding to the locations of the feet of the cash drawer or central processing unit so that the equipment can be secured in place on the bottom wall. As described below, this is achieved by removing the feet of the equipment, placing the equipment on the bottom wall over the slots, and then re-securing the feet through the slots 46.

The two laterally spaced areas of the bottom wall that are adapted to be received beneath the equipment are each formed with several rows of diagonally extending ventilation slots 48 which permit air to flow into the shelf around the equipment to keep it cool. As the equipment on the shelf heats up, the rising warm air draws cooler air through the slots, cooling the equipment. Thus, passive cooling is achieved.

A rectangular opening 50 is formed in the bottom wall roughly halfway between the side walls, and is adapted to permit power cables or the like to be passed through the bottom wall between the equipment on the shelf and a conventional power outlet located beneath the apparatus. Preferably, the opening 50 is located immediately beneath the horizontal cable guide 32 and is aligned laterally with the vertical cable guide 34 so that the cables passing through the guides may pass vertically downward through the opening 50 in the bottom wall.

The side walls 38 are substantially identical to one another, and each includes an upper edge presenting an inwardly directed horizontal flange 52 by which the side wall is secured to the counter by threaded fasteners or the like. The flange of each side wall is parallel to the bottom wall, and includes small holes 54 through which the fasteners are threaded into the counter. If desired, the side walls can be formed with rows of ventilation slots 48 similar to the slots formed in the bottom wall to facilitate air flow through the shelf past the equipment. In addition, a rectangular opening 56 is provided for facilitating access to the equipment during use.

The rear wall 40 also includes an upper edge presenting an inwardly directed horizontal flange 52 that is parallel to the bottom wall, and the flange 52 includes holes 54 through which fasteners are threaded into the counter. As mentioned, the holes in the flanges of the side and rear walls 38, 40 are aligned with the larger access holes 44 in the bottom wall so that a tool can be inserted through the holes 44 to secure the fasteners in place.

Figure 4:
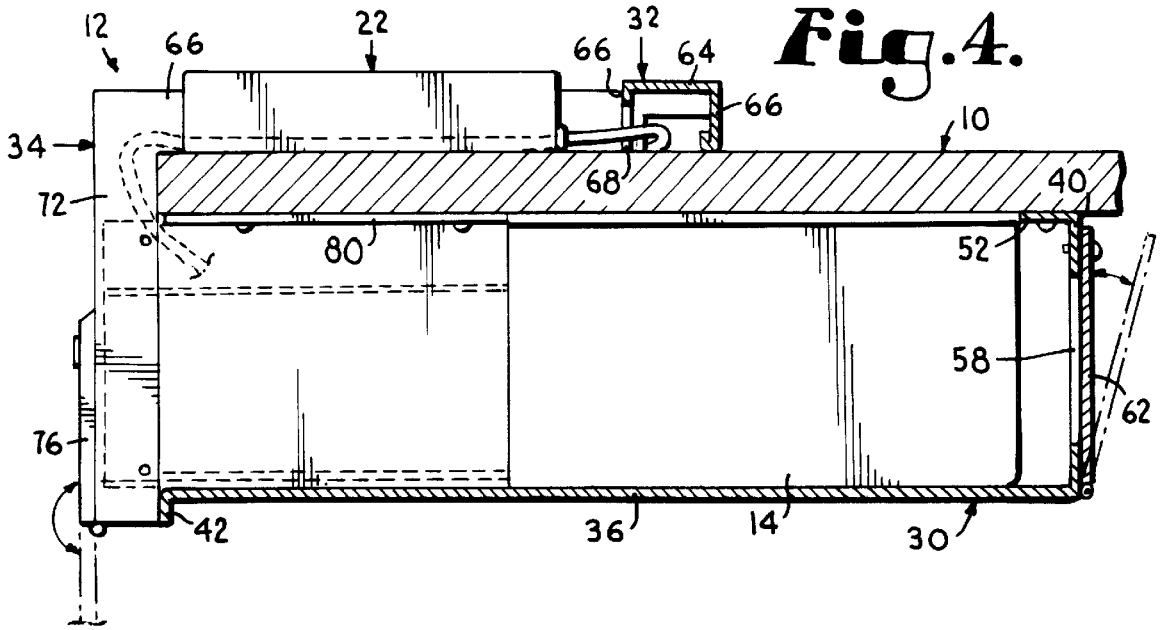
FIG. 4 is a sectional view taken along line 4—4 of FIG. 2.

A large central access opening 58 and two pairs of smaller side access openings 60 are formed in the rear wall to permit access to the equipment during installation. As shown in FIG. 4, a panel 62 is hinged to the bottom shelf and is movable between a raised position covering the openings 58, 60 and a lowered position exposing the openings. Returning to FIG. 1, the side access openings 60 are generally aligned with cable connections on the rear of the cash drawer and the central processing unit so that cables can extend out the rear of the shelf from the openings 60, back into the shelf through the central access opening 58, and through the cable guides 32, 34 to the equipment on top of the counter. Thus, the central processing unit can be pushed completely to the rear of the shelf without bending the cables, and does not protrude forward beyond the front edge of the bottom wall.

The horizontal cable guide 32 includes a T-shaped top wall 64 presenting a base portion and a pair of laterally extending arms. As shown in FIG. 3, the base portion of the top wall 64 extends beyond the front edge of the bottom wall 36 so that the top wall protrudes beyond the counter 10 upon installation of the apparatus. The top wall is generally planer, presenting a smooth upper surface that is attractive and easy to clean, and the guide includes front, rear and lateral upper side walls 66 that depend from the top wall and extend between the top wall and the upper surface of the counter upon installation of the apparatus. As illustrated in FIG. 4, the upper front, rear and lateral side walls 66 present lower edges that are rolled upward into the horizontal cable guide to prevent the lower edges from scratching or otherwise damaging the counter during use. The front side wall of the guide 32 includes three slots 68, shown in FIG. 1, that extend upward from the lower edge on either side of the base portion of the top wall, and the slots are sized for receipt of the cables extending between the central processing unit and the keyboard, monitor, printer, card reader, product code reader and telephone. As such, the cables are trained into the horizontal cable guide beneath the top wall, as shown in FIG. 3, and are concealed from view as they extend across the counter and are wrapped around the front edge thereof.

The vertical cable guide 34 is shown in FIG. 1, and includes a generally rectangular front wall 70 presenting an upper edge that is connected to the front edge of the top wall 64 such that the front and top walls are aligned laterally with one another at the center of the shelf. A pair of laterally spaced front side walls 72 are secured to the front wall 70 and extend between the front wall and the edge of the counter so that the equipment cables passing over the edge of the counter are concealed within the vertical cable guide.

A lock box 74 is welded or otherwise secured to the bottom wall of the shelf 30 at the center thereof in alignment with the cable guides 32, 34, and the vertical cable guide is preferably secured to the lock box by threaded fasteners passing through slots in the front side walls. As such, the vertical cable guide is secured to the shelf and interconnects the shelf and horizontal cable guide to present a single unitary assembly. An opening is formed in the front wall for permitting access to the lock box, and a door or cover 76 is hinged to the front wall and movable between a closed position covering the opening and an open position exposing the opening.

A pair of laterally spaced interior side walls 78 protrude upward from the sides of the lock box toward the counter, and the interior side walls are laterally aligned with the front side walls 72 such that the manifold defined by the horizontal and vertical guides 32, 34 continues beneath the counter between the counter 10 and the lock box 74, as shown in FIG. 4. By providing this construction, the cables are trained back into the shelf and are not allowed to fall forward of the equipment out the front of the apparatus. Returning to FIG. 1, the interior side walls each include an upper edge presenting an outwardly directed horizontal flange 80 by which the side wall is secured to the counter by threaded fasteners or the like. The flange of each interior side wall 78 is parallel to the bottom wall, and includes small holes through which fasteners are threaded into the counter. A plurality of the access holes 44 in the bottom wall are aligned with the holes in the flanges 80 so that a tool can be inserted through the access holes to secure the fasteners in place.

With reference to FIG. 2, in order to mount the apparatus 12 on the counter 10 for use in supporting the equipment, it is positioned on the counter with the horizontal cable guide received above the counter and with the shelf below. Once the apparatus is positioned at the desired location along the counter, threaded fasteners are threaded into the holes in the side and rear wall flanges of the shelf 30 to secure the shelf in place. Fasteners are also threaded into the holes in the interior side wall flanges to support the central area of the shelf. Because the threaded fasteners are driven into the underside of the counter, it is possible to remove the fasteners and dismantle the apparatus from the counter without leaving any residual holes or other indicators in the top of the counter that the apparatus had been mounted there. In addition, because the bottom edges of the front, rear and lateral side walls of the horizontal cable guide 32 are rolled inward into the guide, as shown in FIG. 4, they do not scratch or mar the upper surface of the counter.

After the apparatus is affixed in place, the cash drawer 28 is installed by removing the feet of the cash drawer and placing the drawer in one of the openings presented at the front of the shelf on either side of the lock box 74. The drawer is positioned in the space with the feet holes in the drawer aligned with the slots 46 in the bottom wall 36 of the shelf 30, as shown in FIG. 1, so that the feet can be threaded into the drawer through the slots to secure the drawer in place. Returning to FIG. 2, the central processing unit 14 is positioned in the other opening of the shelf, and the rest of the equipment is positioned on the counter in the manner shown, with the cables of each piece of equipment on top of the counter being trained into one of the slots in the cable guide, as shown in FIG. 3. The cables in the guide 32 extend through the guide to the front edge of the counter and are guided around the edge within the vertical guide and back along the top of the lock box between the side walls, as illustrated in FIG. 4. The panel 62 on the rear wall 40 of the shelf is opened to permit the cables from the counter top equipment to be pulled through the rear wall, and the cables are then directed back into the shelf through the side holes and are connected to the central processing unit 14. The cable from the cash drawer is also guided out the rear wall and is connected to the central processing unit, and power cables from the equipment, as well as a phone line, may be dropped through the rectangular opening 50, shown in FIG. 1, and plugged into an available power outlet.

Although the invention has been described with reference to the preferred embodiment illustrated in the attached drawing, it is noted that substitutions may be made and equivalents employed herein without departing from the scope of the invention as recited in the claims.

I claim:

1. An apparatus for mounting equipment on a counter presenting parallel upper and lower surfaces and a front edge, wherein some of the equipment is to be supported on the counter and other of the equipment is to be supported beneath the counter, and equipment cables extend around the edge of the counter between the equipment supported on the counter and the equipment supported beneath the counter, the apparatus comprising:

a shelf including a bottom wall and a plurality of upstanding lower side walls secured to the bottom wall and adapted to extend between the bottom wall and the lower surface of the counter;

a generally horizontal cable guide including a top wall and a plurality of depending upper side walls secured to the top wall and adapted to extend between the top wall and the upper surface of the counter, the upper side walls having at least one slot sized for receipt of the equipment cables so that the cables on the counter are concealed within the horizontal cable guide; and a generally vertical cable guide connected between the shelf and the horizontal cable guide and including a front wall and a pair of laterally spaced front side walls secured to the front wall and adapted to extend between the front wall and the edge of the counter so that the equipment cables passing around the edge of the counter are concealed within the vertical cable guide.

2. An apparatus as recited in claim 1, wherein each of the upstanding lower side walls includes an upper flange that is substantially parallel to the bottom wall of the shelf, the flanges being provided with a plurality of holes adapted to permit the shelf to be fastened to the counter.

3. An apparatus as recited in claim 2, wherein the bottom wall includes a plurality of holes aligned vertically with the holes in the flanges to provide access to the flange holes through the bottom wall.

4. An apparatus as recited in claim 1, wherein the bottom wall includes a plurality of vent openings for ventilating the area between the bottom wall and the counter during use.

5. An apparatus as recited in claim 1, wherein the upstanding lower side walls include a plurality of vent openings for ventilating the area between the bottom wall and the counter during use.

6. An apparatus as recited in claim 1, wherein the bottom wall of the shelf is adapted to support equipment beneath the counter, and the bottom wall includes a plurality of access slots adapted to permit the equipment to be secured to the bottom wall.

7. An apparatus as recited in claim 1, further comprising a storage box accessible through the front wall of the vertical cable guide, and a door supported on the front wall for closing off the storage box.

8. An apparatus as recited in claim 7, further comprising a pair of interior side walls secured to the front side walls of the vertical cable guide and adapted to extend between the bottom wall and the lower surface of the counter.

9. An apparatus as recited in claim 8, wherein the interior side walls have upper flanges that are substantially parallel to the bottom wall of the shelf, the flanges being provided with a plurality of holes adapted to permit the interior side walls to be fastened to the counter.

10. An apparatus as recited in claim 1, wherein the shelf includes a rear wall secured to the bottom wall and adapted to extend between the bottom wall and the lower surface of the counter, the rear wall including at least one access opening sized for receipt of the equipment cables.

11. An apparatus as recited in claim 10, further comprising a panel supported on the shelf for covering the access opening in the rear wall, the panel being movable to expose the access opening.

12. An apparatus as recited in claim 1, wherein the bottom wall has a front edge that is rolled downward away from the cable guides to strengthen the bottom wall.

13. An apparatus as recited in claim 1, wherein the upper side walls have lower edges that are rolled upward into the horizontal cable guide to prevent the lower edges from damaging the counter during use.

14. An apparatus as recited in claim 1, wherein the upstanding lower side walls include at least one rectangular opening for facilitating access to the shelf.

* * * * *